United States Patent [19]

Luck et al.

[11] 4,208,787

[45] Jun. 24, 1980

[54] PROCESS FOR MAKING A SUBMERSIBLE FUSE

[75] Inventors: Russell M. Luck, Monroeville; Gordon C. Gainer, Penn Hills, both of Pa.

[73] Assignee: Westinghouse Electric Corp., Pittsburgh, Pa.

[21] Appl. No.: 6,830

[22] Filed: Jan. 26, 1979

Related U.S. Application Data

[62] Division of Ser. No. 755,772, Dec. 30, 1976.

[51] Int. Cl.[2] ..... H01H 69/02

[52] U.S. Cl. ..... 29/623; 29/756

[58] Field of Search ..... 29/623, 756; 337/248, 337/251, 252, 246; 338/272, 332; 361/41

[56] References Cited

U.S. PATENT DOCUMENTS

| | | | |
|---|---|---|---|
| 2,333,354 | 11/1943 | Andersen | 337/248 |
| 2,639,350 | 5/1953 | Cox | 337/248 |
| 3,333,336 | 8/1967 | Cameron | 29/623 |
| 3,723,930 | 3/1973 | Koch | 337/158 |
| 3,855,563 | 12/1974 | Cameron | 337/221 |
| 3,911,385 | 10/1975 | Blewitt | 337/186 |

FOREIGN PATENT DOCUMENTS

| | | | |
|---|---|---|---|
| 1099059 | 2/1961 | Fed. Rep. of Germany | 337/248 |
| 601836 | 2/1960 | Italy | 337/248 |
| 65738 | 2/1943 | Sweden | 337/248 |
| 665052 | 1/1952 | United Kingdom | 337/252 |

*Primary Examiner*—Francis S. Husar
*Assistant Examiner*—Gene P. Crosby
*Attorney, Agent, or Firm*—M. J. Moran

[57] ABSTRACT

A process for making a oil resistant tubular fuse for submersion in a hot oil bath is taught. An epoxy resin seal is provided between one portion of a fuse ferrule and an annular groove in the fuse body. Alternatively the epoxy resin seal may be disposed between flared portions of the ferrule and an unscored portion of the tubular body. In both cases the adhesive characteristics of the epoxy are such that the seal retains its sealing capabilities in a temperature range from −40° C. to +150° C.

8 Claims, 3 Drawing Figures

PROCESS FOR MAKING A SUBMERSIBLE FUSE

This is a division of application Ser. No. 755,772, filed Dec. 30, 1976.

BACKGROUND OF THE INVENTION

1. Field of the Invention

The subject matter of this invention relates generally to processes for making oil submersible fuses and it relates more particularly to making fuses with epoxy resin seals which maintain their sealing integrity over a wide temperature range.

2. Description of the Prior Art

It is known in the prior art to make cartridge-type fuses having annular grooves at the ends thereof in which overlaid or telescoped conductive ferrules may be magneformed or crimped for enclosing the ends of the fuse securely. Such a fuse is taught in U.S. Pat. No. 3,855,563 issued Dec. 17, 1974 to F. L. Cameron et al and in U.S. Pat. No. 3,333,336 issued Aug. 1, 1967 to F. L. Cameron et al. Both of the above patents are assigned to the assignee of the present invention. An electromagnetic crimping or securing process is taught in the latter noted U.S. Patent. It is also known to generally provide some form of seal at the interface between the edge of a fuse ferrule and the protective fuse barrel or body to generally prevent the surrounding environment from affecting the internal portion of the fuse. Such a fuse is taught in U.S. Pat. No. 3,911,385 issued Oct. 7, 1975 to D. D. Blewitt et al. In that case a sealant such as silicone rubber is disposed as a bead between the edge of a ferrule and an epoxy-covered glass melamine fuse ferrule. The fuse described in that case is for outdoor use where the fuse is likely to be exposed to a relatively hostile environment. The bead is provided to enhance the weatherproof qualities of the fuse. None of the prior art apparently teaches the use of a seal between a fuse ferrule and protective body for a fuse which is submersible in hot oil such as might be found in a transformer which may be part of an underground electrical distribution system. The relatively high current ratings and high operating temperatures for the oil of such a system exceeded known fuse sealing material's capability particularly as regards to resistance to hot transformer oil. Furthermore, it has been found that attempting to apply epoxy resin to a fuse barrel for sealing it is difficult to center the ferrule relative to the tube to allow the epoxy resin to flow evenly around all parts of the interface between the ferrule and the tube. This problem produces an epoxy deficient dry seal area. It has also been found that after applying liquid epoxy resin at room temperature the subsequent curing process, i.e., the raising of the temperature of the tube subsequent to apporoximately 140° C., causes trapped gas (air) to expand through the still liquid or gelatinous epoxy causing blowout paths or vent holes therein. These paths or holes form potential leak regions when the fuse is submersed in oil. It would be advantageous therefore if a seal for an oil submersible fuse could be found which would operate in a relatively hot transformer oil environment and which had sufficient flexibility and adhesion properties to maintain an oil-resistant sealing capability over a wide range of temperature.

SUMMARY OF THE INVENTION

In accordance with the invention an oil-submersible fuse is taught which includes a main fuse body having an annular groove inscribed therein. The annular groove is longitudinally aligned at one end of the fuse panel in the vicinity of the termination of the open end of a ferrule which is disposed in telescoping fashion over the aforementioned end of the fuse barrel. The annular groove aligns with the edge of the ferrule in such a manner that epoxy resin material may be disposed in the groove. The adhesive characteristics of the epoxy resin material are such that it maintains a sealing bond with the filament wound epoxy glass tubes of the fuse barrel and with the metal of the ferrule over a wide temperature range.

BRIEF DESCRIPTION OF THE DRAWINGS

For a better understanding of the invention reference may be had to the preferred embodiment exemplary of the invention shown in the accompanying drawings in which.

DESCRIPTION OF THE PREFERRED EMBODIMENT

Figure 1:
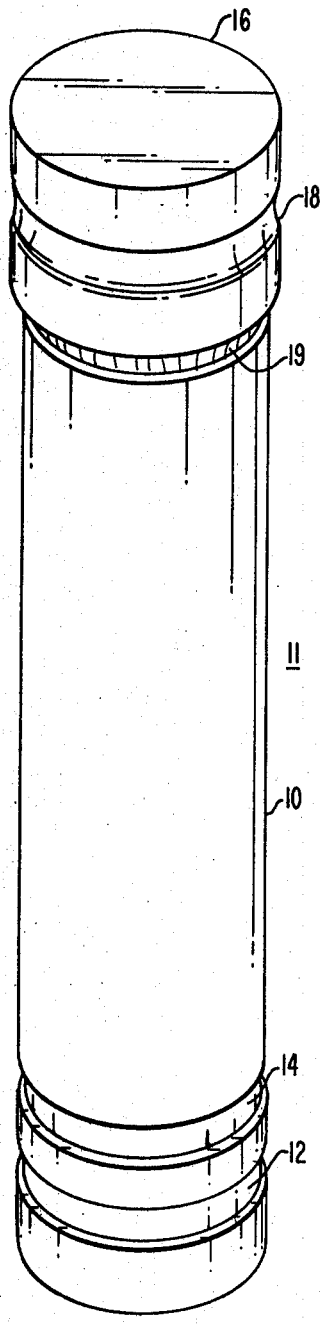
FIG. 1 shows an isometric view of an oil-resistant fuse with one end ferrule missing for purposes of illustration.

Referring now to the drawings and FIG. 1 in particular a glass filament-wound tube or fuse barrel 10 for a fuse 11 is shown. There are shown on the bottom portion of the barrel 10 as viewed in FIG. 1 two annular grooves 12 and 14. The radii of the annular grooves 12 and 14 are generally perpendicular to the longitudinal axis (not shown) of the tube 10. The bottommost groove 12 as shown in FIG. 1 is utilized in the magneforming process which is described in previously referred to U.S. Pat. No. 3,333,336. The topmost groove 14 shown in FIG. 1 is utilized in the sealing process which will be described more fully hereinafter. Shown on the top of fuse 10 as seen in FIG. 1 is a fuse ferrule 16 which has been magneformed to the tube 10 at 18 and which has been sealed at 19 in accordance with a process which will be described hereinafter. The seal 19 shown on FIG. 1 is made with the use of an epoxy resin which has been properly cured.

One of the most important properties of a resin suitable for sealing an oil-submersible fuse is that the cured resin seal be resistant to hot transformer oil. Any material used to seal the epoxy glass filament-wound tube 10 to the metal ferrule 16 must be unaffected by hot (140° C.) transformer oil as revealed by a low weight increase and by a low linear expansion in the presence of the hot oil. In reviewing the properties of various types of resin sealants an anhydride cured epoxy resin system appears to provide the best all around properties required of a fuse sealant: that is, retention of strength at high temperature together with adequate resistance to hot transformer oil. For this reason an anhydride epoxy sealing composition has been developed which provides the desired oil resistance and also continues to provide adhesion to both the glass filament-wound tube 10 and the metal ferrule 16 during thermocycling (−40° C. to +150° C.). The ferrule 16 shown in FIG. 1 may be a copper-based alloy having a tin-plated coating. It has been found during the development of the process for sealing that the tin plating must be removed from the portion of the ferrule to which adhesion by the epoxy sealant is required. It has been found that an epoxy resin system is available that provides adequate adhesion to both the metal ferrule 16 and the glass filament-wound tube or barrel 10. This resin is capable of withstanding thermal stresses which are set up during thermal cycling which varies from −40° C. to +150° C. It has been found by experimentation that the magneforming or securing operation for the ferrule 16 to the tube 10 is a required operation and furthermore the securing operation must be accomplished prior to the provision of the resin sealing material to the tube. It has also been found by experimentation that heat curing epoxy resins provide the best adhesive properties to both the tube 10 and the ferrule 16 when subjected to the thermal stresses of hot transformer oil. Finally, it has also been determined experimentally that all or at least a considerable part of the air trapped in the tube and between the magneformed seal and the liquid epoxy seal has to be excluded or greatly reduced before the epoxy seal is applied to the tube 10 to reduce the likelihood of forming blow holes during the gelation process of the epoxy material under curing temperature.

Figure 2:
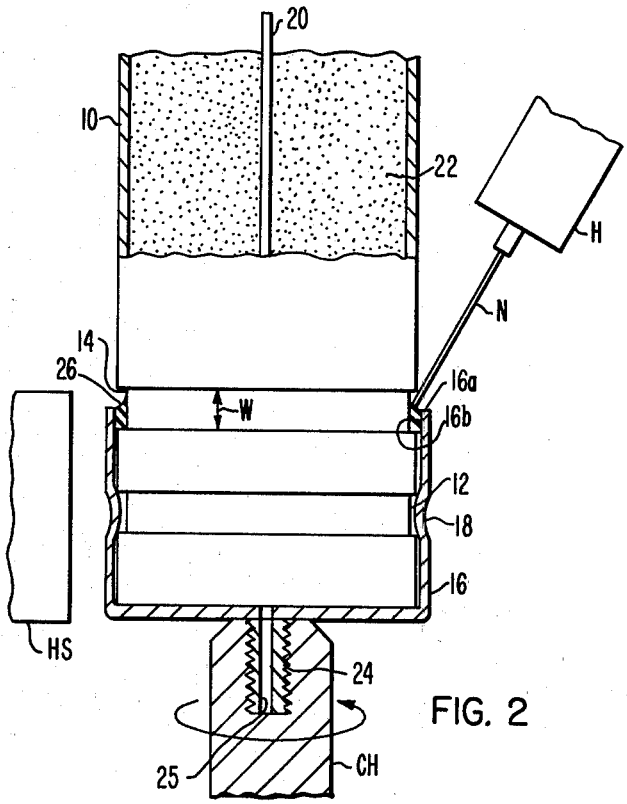
FIG. 2 shows an elevation of the oil-resistant fuse of FIG. 1 partially broken away and partially in section as it is disposed during a sealing process.

Referring now to FIG. 2 a section of the fuse 11 of FIG. 1 is shown. The fuse barrel 10 is shown with its two rectangular cross-section annular grooves 12 and 14. The ferrule 16 has centrally disposed axially thereof a threaded protrusion 24 which may be conveniently threaded into a chuck member CH for rotation. Prior to insertion of the threaded member 24 into the chuck member CH, the ferrule is magneformed or securely attached to he fuse barrel 10 at the region 18. The securing process utilized may be similar to that described in the previously mentioned U.S. Pat. No. 3,333,336. The process utilized to form the seal 26 is described hereinafter:

An epoxy sealing composition identified for purposes of simplicity by the symbols B10-156-1) is designated as having parts A, B and C where:

Part A—100 parts ERLA 4221—Such as is sold by Union Carbide Company.

Part B—97 parts PAPA—Polyazelaic polyanhydride—Such as sold by Emery Industries. 15 parts HHPA Hexahydro Phthalic Anhydride—Such as sold by Alcoa.

Melt part B in an oven at 90° C. to 100° C. Add part A to melted part B and stir 2 to 5 minutes until thoroughly mixed (temperature should be approximately 50° C. to 60° C. To this clear warm solution under vigorous stirring add part C by "dusting in" to reduce clumping. Stirring should be continued from 5 to 10 minutes until a smooth creamy mix is formed. Temperature during mixing should not exceed 60° C. to 70° C. The mix is now ready for use. The epoxy resin at this point should not be exposed to atmospheric humidity for an extended period. As the mixture cools it will thicken and harden slightly. Slight heating to between 50° C. and 60° C. with stirring will normally convert it back to a creamy mix.

Preparation of the fuse tube body:

Still referring to FIG. 2, the epoxy glass filament-wound fuse body 10 should have two sets of two grooves 12 and 14 each machined or otherwise cut off formed into each end of the tube 10. One groove 12 should accept the magneformed ferrule 16 at 18. A portion of the other groove 14 is aligned with the edge **16*a* of the ferrule 16 for epoxy sealing. The sealing groove 14 should extend in a preferred embodiment from about two-thirds to three-fourths of its width W below the ferrule edge 16*a* as shown in FIG. 2. and about one-third to one-fourth of its width W above the ferrule edge as shown in FIG. 2**.

One ferrule 16 per each fuse 11 should be provided with a one-sixteenth of an inch to a one-thirty second of an inch vent hole 25. For purposes of illustration hole 26 is shown in portion 24 of FIG. 2. In actuality though, since the ferrule 16 of FIG. 2 is the first to be sealed, the opening 25 would be in the opposite ferrule (not shown). The ferrule 16 should be clean and free of all grease and oil-type film particularly around the sealing surface of **16*b*. If a copper (unplated) ferrule is used, it need not be abraded, but should be free of oil and grease film. If a tin-plated copper ferrule is used, the surface of the sealing area 16*b*** should be abraded to remove the tinplate and to expose bare copper. It has been found that the above indicated epoxy resin provides significantly improved adhesion against copper rather than tin.

The fuse sealing technique:

The fuse should be assembled and secured in a standard manner to include a fusible link 20. Arc quenching material such as quartz sand 22 may be used. The sand-filled fuse as thus constructed should be heated in an oven at 135° C. to 140° C. for one to two hours or until the entire fuse reaches a temperature of approximately 135° C. to 140° C. The hot fuse upon removal from the oven is placed into the chuck CH and rotated at 60 RPM for example. A hot air gun HS or an infra-red lamp or radiant heater should then be positioned to maintain the temperature of the ferrule 16 at between 135° C. and 140° C. Within one minute or so of the removal of the fuse from the oven the previously described epoxy resin mix should be slowly injected through a syringe H fitted with a size 16 needle N to fill the region between the ferrule 16 and tube groove 14 as is shown in FIG. 2. Care must be taken not to add the resin with such rapidity that a liquid lock forms around the edge of the seal. This prevents hot expanded air from properly venting from the region between the seal and the magneform for example and it may also prevent the resin material from flowing into and filling a portion of the groove 14. It is to be noted that the seal formed by the sealing technique when used with the first ferrule to be sealed is less likely to be subjected to gas pressure because the other end of the fuse panel is vented to the atmosphere at this time. This is the reason the vent hole 27 is placed in the protrusion 24 of the last ferrule to be applied. The resin should be added slowly and intermittently to avoid the previously described liquid lock. Complete insertion of sealing material into the groove 14 should require no more than one or possibly two minutes depending upon the size of the fuse being sealed. The hot air source HS is utilized at this time to maintain a steady temperature of 135° C. to 140° C. at the appropriate place. After the groove 14 has been adequately filled with the sealing epoxy, the heat from the hot air gun HS is continued for another four or five minutes at 135° C. to 140° C. while rotating the fuse at 60 RPM until gelation of the epoxy resin occurs. After gelation of the epoxy resin of the first ferrule seal 26, the threaded portion 24 of the opposite ferrule should be inserted into the chuck CH and preheated by the hot air gun HS for approximately 1½ minutes or until the ferrule 16 is at approximately 135° C. to 140° C. The epoxy injection and gelation process is then repeated as described previously. After both ferrules 16 have been epoxy sealed at 19 and 26 and gelled the entire fuse 8 should then be heated for four to six hours at 135° C. to 140° C. in an oven to complete the cure of the resin. It is important to remember that the ferrule that does not contain the vent hole (25 shown in FIG. 2) should be sealed first by the process previously described. The whole fuse and particularly the ferrule 16 should be maintained at 135° C. to 140° C. during the entire sealing process. After the above has been accomplished the vent hole 23 may be sealed by using an effective soldering or welding technique.

It is important to note that an important feature that has been discovered concerning this process is the preheating of the entire fuse at the approximate cure temperature of the epoxy resin. It will be noted by referring to FIG. 2 that the cured seal 26 effectively prevents oil leakage from outside of the fuse barrel 10 into the central region of the fuse barrel 10 where deleterious effects may occur. It has been found by experimentation that hot cured epoxy-type resins were best for adhesive purposes as was described previously. However, when the fuse was raised to the temperature of curing which is approximately 135° C. to 140° C. the sand 22 or the barrel 10 of the tube itself or the trapped air in the region of the magneform 18 all or singularly contribute to the exiting of gas through the curing seal 26 thus providing leak holes which are detrimental to the desired operation of the fuse. It has therefore been discovered that a preheated fuse which had established a gas evolution equilibrium is desirable. It is for this reason that the fuse is preheated in an oven to approximately the curing temperature of the epoxy. Consequently any gases which are likely to be evolved have reached an equilibrium state at this time and the sealing material can be injected into the region of the groove 14 without causing differential pressure to be established across the gelling seal 26 which would cause the previously described blowholes.

Figure 3:
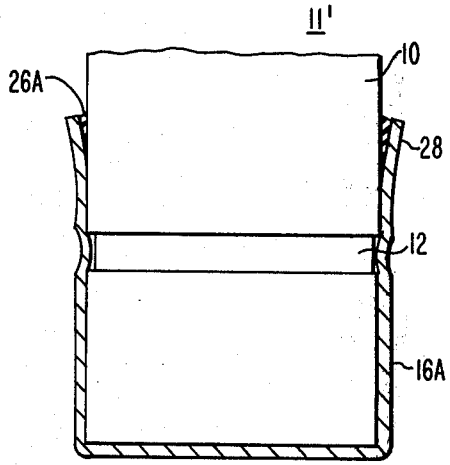
FIG. 3 shows an elevation of a fuse similar to that shown in FIG. 1 partially in section and partially broken away which is constructed utilizing a different sealing process.

Referring now to FIG. 3 still another embodiment of the invention is shown. In this case the fuse barrel 10 of a fuse 11' has only one annular groove 12 per end scored or cut therein. The magneforming process is utilized with a ferrule 16A to securely attach the ferrule 16A to the fuse body 10. The open portion of the ferrule 16A is flared at 28 to provide a suitable receptacle for the epoxy resin material to form the seal 26A as shown in FIG. 3. The process for heating the tube and applying the epoxy material and curing is essentially the same as was described with respect to the embodiment of FIG. 2.

It is to be understood that with respect to the embodiments shown in the drawing that a rectangularly shaped annular groove 14 is not a necessity. However, it is advantageous to provide this form of groove inasmuch as certain kinds of machining tools are best utilized for making angularly shaped grooves. It is also to be understood that the magneforming process is not limiting. In some embodiments of the invention other effective ferrule attaching processes may be used. Although the tube barrel 10 has been described as being formed preferably from filament-wound glass epoxy material this does not exclude other types of suitable electrically insulating fuse barrel material (such as glass melamine) provided that the material reacts to the process described previously in a similar manner to filament-wound glass epoxy material.

The apparatus taught with respect to the embodiments of this invention have many advantages. One advantage lies in the fact that an adhesive seal of epoxy material may be utilized for an oil-submersible fuse, which fuse may be subjected to a temperature of 150° C. while submerged in an oil bath. This fuse if constructed according to the techniques of this invention, will retain a seal which is flexible and oil retardant over a wide range of temperatures. This is especially true when considering the adhesive qualities of the epoxy material to the inner annular surface of the ferrule and to the glass melamime or fiberglass-wound tube barrel 10. An advantage of a fuse as constructed according to the previously described technique is that the fuse may be utilized in underground distribution systems utilizing oil-submersion techniques.

We claim:

1. A process for making an oil submersible fuse, comprising the steps of:

(a) forming a first continuous annular groove around the outside of one end region of a hollow tubular electrically insulating barrel;

(b) forming a second continuous annular groove around the outside of the other end region of said barrel;

(c) disposing securely a first fuse ferrule on said one end region so that the edge of said first ferrule aligns with said first groove;

(d) disposing securely a second fuse ferrule on said other end region so that the edge of said second ferrule aligns with said second groove;

(e) heating said fuse to the curing temperature of a predetermined epoxy resin material until the gas generaton of the material of said fuse due to heating to said temperature has substantially ceased;

(f) applying said epoxy resin to said region of said first annular groove and to said region of said second annular groove at said curing temperature to substantially fill a region between said first annular groove and said first ferrule and to substantially fill a region between said second annular groove and said second ferrule with uncured epoxy resin; and (g) curing said epoxy resin at said curing temperature to form flexible seals in said first and said second annular grooves.

2. The method as claimed in claim 1, comprising the additional step of:

(a) forming an additional annular groove in either end of said barrel and magneforming said first and said second ferrules therein.

3. A process for making an oil submersible fuse, comprising the steps of:

(a) forming a first continuous annular groove around the outside of one end region of a hollow tubular electrically insulating barrel;

(b) forming a second continuous annular groove around the outside of the other end region of said barrel;

(c) disposing securely a first fuse ferrule on said one end region so that the edge of said first ferrule aligns with said first groove;

(d) disposing securely a second fuse ferrule which has a gas vent therein on said other end region so that the edge of said second ferrule aligns with said second groove;

(e) heating said fuse to the curing temperature of a predetermined epoxy resin material until the gas generation of the material of said fuse due to heating to said temperature has substantially ceased;

(f) applying said epoxy resin to said region of said first annular groove at said curing temperature to substantially fill a region between said first annular groove and said first ferrule with uncured ekpoxy resin; then (g) applying said epoxy resin to said second annular groove at said curing temperature to substantially fill a region between said second annular groove and said second ferrule with uncured epoxy resin; then (h) curing said epoxy resin at said curing temperature to form flexible seals in said first and said second annular grooves; and then (i) sealing off said gas vent.

4. The method as claimed in claim 3, comprising the additional steps of:

(a) forming an additional annular groove in either end of said barrel and magneforming said first and said ferrules therein.

5. A process for making an oil submersible fuse, comprising the steps of:

(a) flaring outwardly the opened end of a first fuse ferrule;

(b) flaring outwardly the opened end of a second fuse ferrule;

(c) disposing securely said first fuse ferrule on one end region of a hollow tubular electrically insulating barrel;

(d) disposing securely said second fuse ferrule on the other end region of said hollow tubular electrically insulating barrel;

(e) heating said fuse to the curing temperature of a predetermined epoxy resin material until the gas generation of the material of said fuse due to heating to said temperature has substantially ceased;

(f) applying said epoxy resin to the volume between said first ferrule flare and said fuse barrel and to the volume between said second ferrule flare and said fuse barrel at said curing temperature to substantially fill said latter volumes with uncured epoxy resin; and (g) curing said epoxy resin at said curing temperature to form flexible seals.

6. The method as claimed in claim 5, comprising the additionaly step of:

(a) forming annular grooves in either end of said barrel and magneforming said first and said second ferrules therein.

7. A process for making an oil submersible fuse, comprising the steps of:

(a) disposing securely a first flared fuse ferrule on one end region of a hollow tubular elecrically insulating barrel;

(b) disposing securely a second flared fuse ferrule which has a gas vent therein on the other end region of said insulating barrel;

(c) heating said fuse to the curing temperature of a predetermined epoxy resin material until the gas generation of the material of said fuse due to heating to said temperature has substantially ceased;

(d) applying said epoxy resin to the volume between said first ferrule flare and said fuse barrel at said curing temperature to substantially fill said latter volume with uncured epoxy resin; then (e) applying said epoxy resin to the volume between said second ferrule flare and said fuse barrel to substantially fill said latter volume with uncured epoxy resin; then (f) curing said epoxy resin at said curing temperature to form flexible epoxy resin seals; and then (g) sealing off said gas vent.

8. The method as claimed in claim 7, comprising the additional step of:

(a) forming annular grooves in either end of said barrel and magneforming said first and said second ferrule therein.

* * * * *